United States Patent [19]

Green et al.

[11] Patent Number: 4,888,918

[45] Date of Patent: Dec. 26, 1989

[54] FIRE-RESISTANT DOOR

[75] Inventors: F. Richard Green, Fairfield; Charles C. Kreimer, Cincinnati, both of Ohio

[73] Assignee: Pease Industries, Inc., Fairfield, Ohio

[21] Appl. No.: 310,791

[22] Filed: Feb. 14, 1989

[51] Int. Cl.[4] ..... E06B 3/00

[52] U.S. Cl. ..... 49/501; 52/829

[58] Field of Search ..... 49/501; 52/630, 803, 52/785, 829, 830

[56] References Cited

U.S. PATENT DOCUMENTS

| | | | |
|---|---|---|---|
| 2,433,767 | 12/1947 | Kuettel | 52/829 |
| 3,386,209 | 6/1968 | Starlevic | 49/501 |
| 3,426,479 | 2/1969 | Pease | 49/501 |
| 3,512,305 | 5/1970 | Multer | 52/829 |
| 3,987,588 | 10/1976 | Imperial et al. | 49/501 |
| 4,167,088 | 9/1979 | Governale | 49/501 |

*Primary Examiner*—Kenneth J. Dorner
*Assistant Examiner*—Gerald A. Anderson
*Attorney, Agent, or Firm*—Biebel, French & Nauman

[57] ABSTRACT

The fire resistance of a metal skin covered door wherein the stile on the lock side projects between the skins for on site trimming purposes is more than doubled by directly connecting one leaf of each hinge to one of the skins and by directly connecting the skins to each other with a metal strap positioned on the top of the door close to the lock side edge thereof.

10 Claims, 4 Drawing Sheets

FIRE-RESISTANT DOOR

BACKGROUND OF THE INVENTION

Doors comprising a skeleton of wood stiles and rails covered on each side with a metal skin have been widely and successfully used for a substantial period of years. One example of a door of this construction which has had outstanding commercial success is provided by Pease U.S. Pat. No. 3,153,817 of 1964. The metal skins on the door of that patent include flanges along both sides thereof which overlap the edges of the wooden skeleton, and these flanges include additional flanges along their outer edges which are parallel with the skins and fit into a groove in the edge of the wood skeleton but are spaced from each other within that groove to provide an air gap minimizing heat transfer from one skin to the other.

A practical disadvantage of doors constructed in accordance with the Pease patent is that because both side edges of the door are covered with metal flanges, except for the air gap therebetween, the lateral dimensions of the door are fixed, and it is not possible to make any adjustment in those dimensions to accommodate irregularities in the door frame in which it is to be mounted. Also, it is standard manufacturing practice with such doors that the necessary openings in the flanges covering the lock side edge of the door to receive latch and lock hardware are cut at the factory, and the hardware to be installed in such a door is therefore practically limited to such hardware as will accurately fit those openings.

At least in part for each of these reasons, there is a substantial market for metal skin covered doors wherein the flanges on the sides of the skins do not fully cover the edges of the wood skeleton, and some wood projects beyond those flanges so that it can be planed or sanded as may be required to fit within a particular door frame, as well as slotted as needed to receive particular hardware. For example, Seely U.S. Pat. No. 4,152,876 of 1979 shows a metal faced door wherein the retaining flanges on the metal skins are set in slots in the sides of the stiles so that a portion of each of these stiles projects beyond the flanges and can be trimmed as needed to fit within a particular door frame, as well as slotted to receive a latch assembly.

There is a fire resistance limitation with doors constructed as shown in the Seely patent, as well as with similar doors wherein the flanges on the metal skins are retained in rabbets along the edges of the stiles, in that their fire resistance is undesirably low. For example, when subjected to a particular test procedure identified as ASTM E-152-81a, which rates in minutes the ability of each tested door to withstand those conditions, doors constructed in accordance with the Pease patent have a rating of 90 minutes.

In contrast, metal skin covered doors wherein substantial portions of the stiles are exposed have proved to be incapable of a rating higher than 20 minutes. This is an increasingly important consideration for the door making industry, because there is an increasing tendency for building codes to require specific fire resistant rating substantially higher than 20 minutes for door installations such, for example, as entry doors to hotel rooms, and between a residence and its attached garage, for which 45-minute ratings in a steel frame are often required.

SUMMARY OF THE INVENTION

The primary object of the present invention is to provide a metal skin covered door which has the practical advantages of both varieties of such doors described hereinabove, and which in particular will have a fire rating significantly higher than it has been impossible to attain heretofore with such doors which provide the adjustability feature of a door like those of the Seely patent.

In accordance with the invention, this object is accomplished by the provision of a door comprising a wood skeleton covered with metal skins in such manner that at least one of the hinge side and lock side stiles projects beyond or is exposed between the metal skins for such trimming and/or slotting as may be necessary during installation, and wherein the skins are fastened to each other and to the hinges for the door in such manner as to achieve a fire rating significantly higher than has heretofore been possible with such a skin covered door.

In a preferred example of a door according to the invention which accomplishes this object, inturned flanges on the edges of each skin are set in rabbets extending along both outside corners of the lock side and hinge side stiles in the wood skeleton, and at least on the lock side of the door, a significant portion of the stile projects beyond the skin flanges for such trimming and/or slotting as may be necessary or desirable during installation of the door in a door frame. The hinges by which the door is so mounted are directly connected to the flange along the side of at least one of the skins, to provide a positive connection through the hinges to the door frame.

In addition, the skins are also directly connected to each other adjacent the lock side of the door, preferably by means of a metal strap that extends across the top of the door and is directly connected to the flanges along the tops of both skins. In a preferred embodiment, these direct connections are effected by sheet metal screws which directly connect the hinges to the skin flanges and which also directly connect the flanges along the top of the door to the metal strap that extends therebetween, all as described hereinafter in connection with the drawings.

DESCRIPTION OF THE PREFERRED EMBODIMENT

Figure 1:
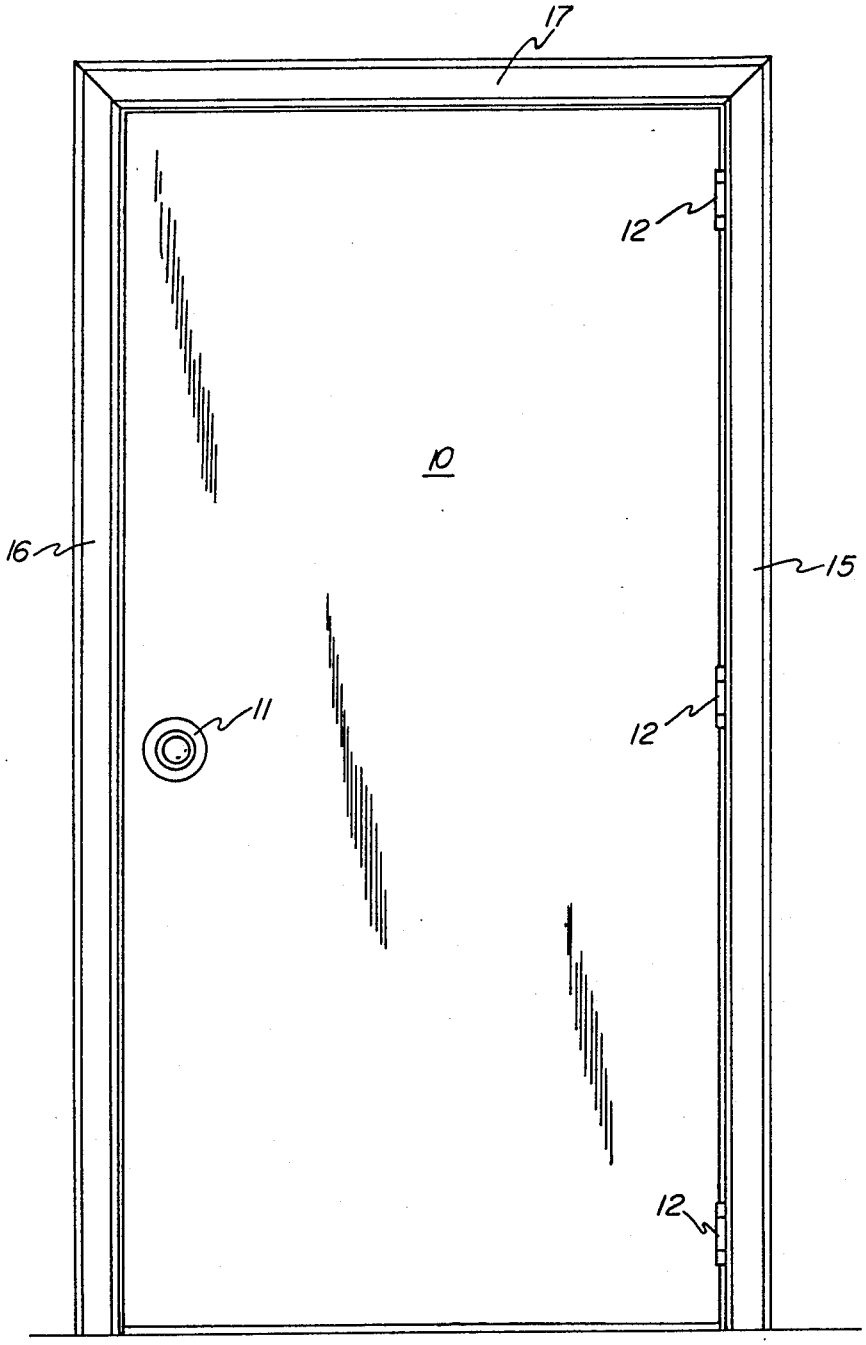
FIG. 1 is an elevation illustrating a door constructed in accordance with the invention and having a hinged mounting in a conventional door frame.

In FIG. 1, a door 10 constructed in accordance with the invention and having a conventional handle 11 is mounted by multiple hinges 12 in a door frame which includes a conventional hinge side jamb 15, lock side jamb 16 and top jamb 17. The door 10 comprises metal skins 20 and 22 mounted on a skeleton composed of a lock side stile 25, a hinge side stile 26, a top rail 27 and a bottom rail 28. The interior of this wood skeleton is filled with core material 30, preferably a foamed plastic such as polyurethane or polystyrene, and the skins 20 and 22 are secured to the wood skeleton and the core 30 by conventional adhesive.

Each of the metal skins 20 and 22 is provided with a right angled inturned flange 33 along each of its side edges. Each of these flanges 33 is sufficiently less in width than the stile 25 to expose a substantial area of the stile between the opposed flanges. For example, if the stile is 1.62 inches in width, each of the flanges 33 may be approximately 0.25 inch in width so that the exposed area of stile 25 is approximately 1.12 inches wide.

Figure 2:
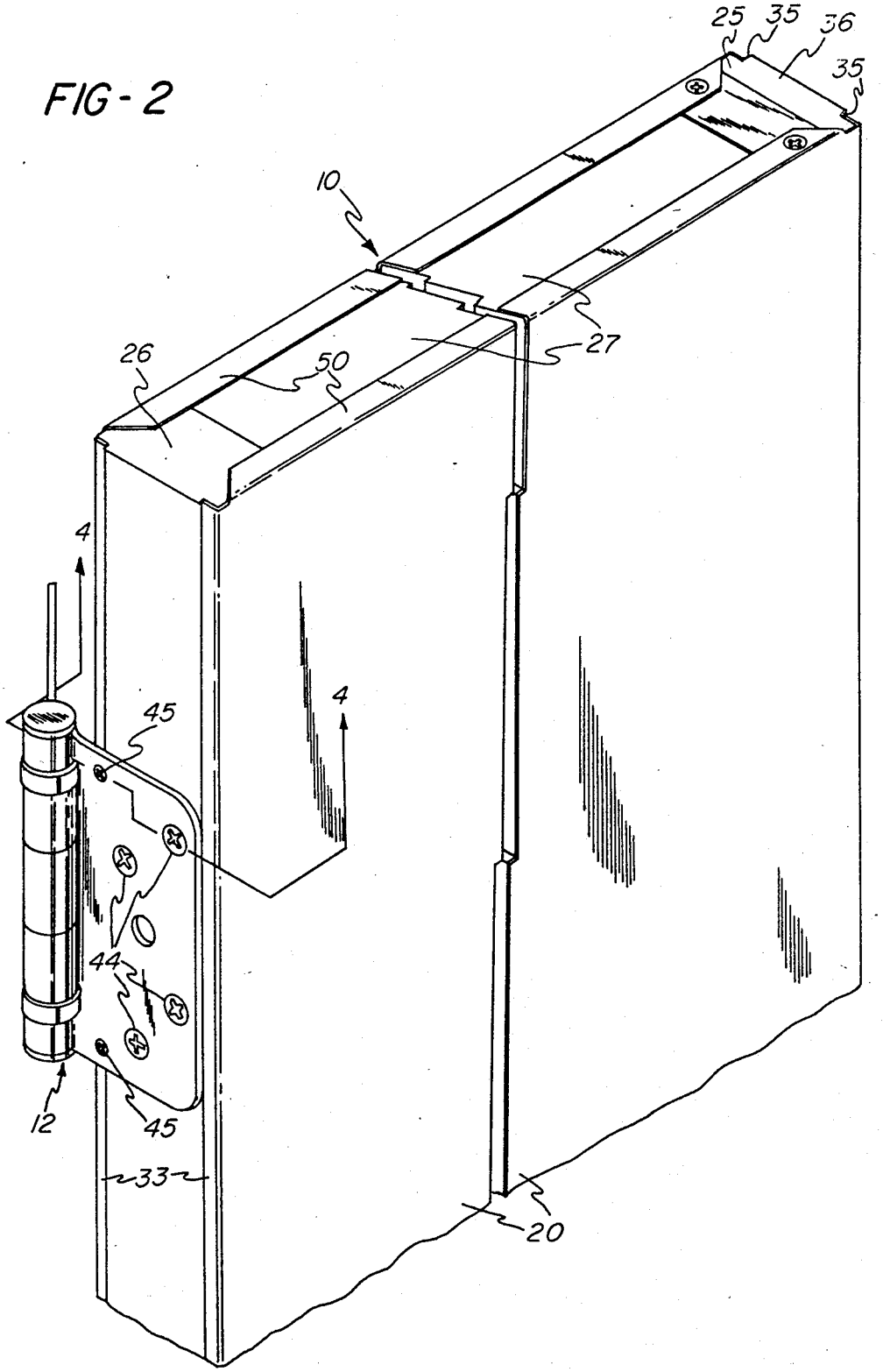
FIG. 2 is a fragmentary perspective view illustrating the upper portion of the door in FIG. 1 as viewed from the hinge side.
Figure 3:
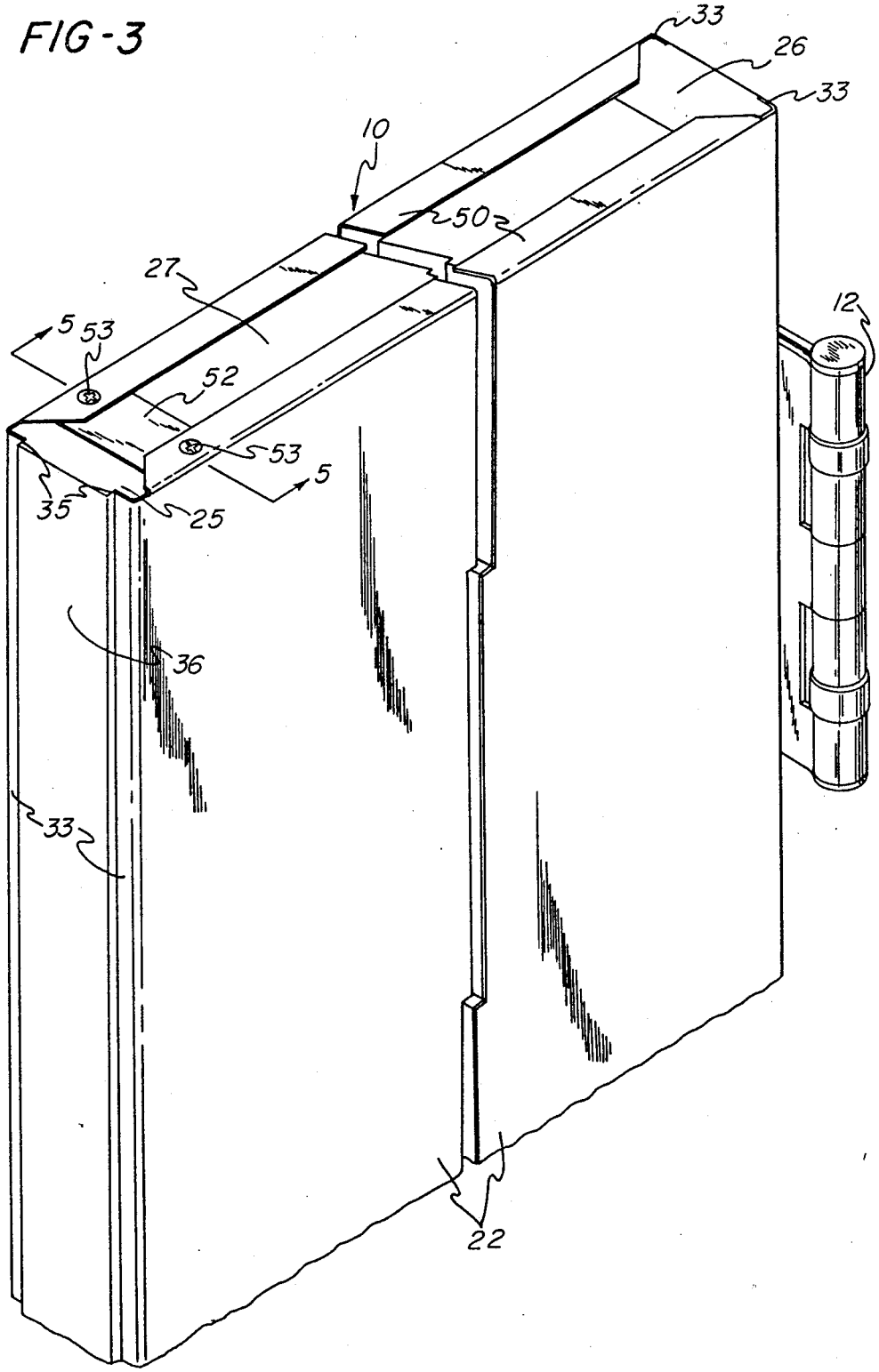
FIG. 3 is a perspective view similarly illustrating the door in FIGS. 1 and 2 as viewed from the lock side.

The lock side stile 25 is provided along each of its outer vertical edges with a rabbet 35 of such dimensions as to receive therein the flange 33 on the adjacent skin 20 or 22 and also to provide a substantial thickness of stile material projecting beyond those flanges as shown at 36 in FIGS. 2 and 3, e.g. a thickness of approximately 0.15 inch.

The hinge side stile 26 is also rabbeted along its outer side edges, but these rabbets 40 are shown as only sufficiently deep to receive the thickness of the flanges 33 so that the hinge side edge of the door is essentially smooth across its width. Alternatively, the rabbets 40 can be made of approximately the same dimensions as the rabbets 35 along the lock side stile 25, but in that case, the resulting projecting portion of the stile 26 should be mortised flush with the flanges 33 to receive one leaf of each of the hinges 12. In another alternative, the flanges 33 may be received in slots cut in the sides of the stiles rather than rabbets in the edges of the stiles.

As shown in FIG. 2, one leaf of each hinge 12 is mounted directly on the exposed edge of the stile 26 by a plurality of conventional wood screws 44. In addition, each of these hinge leaves is mechanically connected with one of the skin flanges 33, by a pair of screws 45 threaded through the flange 33 into the stile 26. As shown, the screws 45 are sheet metal screws, which are self-tapping to provide positive connections between the hinge leaf and the flange 33.

Each of the metal skins 20 and 22 is also provided with a right angled inturned flange 50 along its top and bottom edges. These flanges 50 are preferably somewhat wider than the flanges 33, e.g. a width such that the exposed area of the rails 27 and 28 between opposed flanges 50 is approximately 0.75 inch wide. The stiles 25 and 26 extend to the top of the door substantially flush with the top surface of the top rail 27, and these parts are not rabbeted, so that the flanges 50 overlap the wood surfaces.

A highly fireproof connection is provided between the opposed flanges 50 at a position closely adjacent the front edge of the door, by means of a flat steel strap 52 which spans the top of the stile 25 and the adjacent end of top rail 27 and extends underneath the flanges 50, to which it is positively connected by a pair of self-tapping sheet metal screws 53. It is important that this connection between the skins be located well above the center of gravity of the door, and its location on the top of the door accomplishes this objective as well as being out of sight in the installed position of the door.

Figure 5:
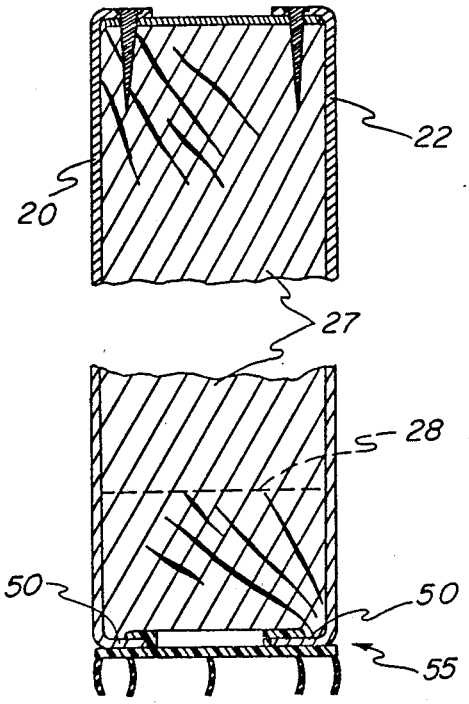
FIG. 5 is a fragmentary section on the line 5—5 in FIG. 2.

At the bottom of the door, inturned flanges 50 overlap the bottom ends of the stiles 25 and 26 and the bottom surface of the rail 28 but are not directly connected thereto or to each other. However, the bottoms of the two stiles and the bottom rail are relieved, to provide tracks in which weather stripping 55 may be slidable mounted as illustrated in FIG. 5.

Tests indicate that the addition of the direct connections of the skins 20 and 22 to the hinges 12 and to each other by means of the strap 52 provide a dramatic increase in the ability of the door to resist destruction by fire. Thus in comparative testing according to ASTM Test E-152, wherein the side of the door exposed to the flame is heated to 1850° F. while the unexposed side reaches 1100° F., a door constructed as shown in the drawings but without the screws 45 and strap 52 could not achieve a rating of 20 minutes before failing.

In contrast, a similar door provided with the screws 45 and connecting strap 52, which are greatly more resistant to both heat and combustion than the wood skeleton of the door, and with the skin on the hinge barrel side of the door, i.e. skin 22, exposed to the higher heat, achieved a rating of 45 minutes and also successfully withstood the subsequent hose stream test, notwithstanding the fact that the wooden components of the door were completely consumed, because the mechanical connections provided by the screws 45, and the strap 52 and screws 53, held the skins 20 and 22 together and in place.

As described above, the use of self-tapping screws 45 and 53 has proved to be highly effective in achieving the results desired for the invention, because they provide direct mechanical and highly heat resistant connections between the metal parts with which they are used without detracting cosmetically from the appearance of the finished door. It is to be understood, however, that mechanically equivalent connecting means could be substituted for these screws, such for example as rivets or welded connections capable of withstanding heat conditions under which the wooden components of the door are consumed.

Figure 4:
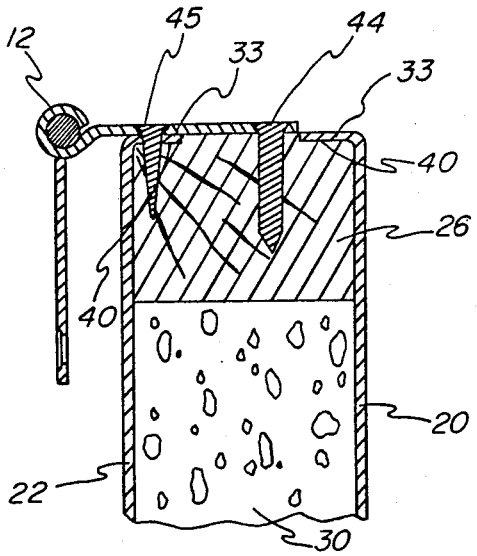
FIG. 4 is a fragmentary section on the line 4—4 in FIG. 3.

It should be noted that the fire rating of doors in accordance with the invention has been obtained with doors having hinges which do not span the thickness of the door as shown in FIGS. 2 and 4. If hinges having larger leaves are used, they may be directly connected to both skins by additional screws 45. Also, the hinge leaves can be mounted on and similarly directly connected to the face of skin 22, but this is conventionally less desirable. In every case, the hinges hold the skin 22 securely attached to the hinge jamb part of the door frame, while the other skin is retained against separation from skin 22 by the conventional stop portion of the door frame which establishes the closed position of the door.

It should also be noted that the practice of the invention provides the same advantages with doors which do not include a projecting stile portion 36 on either edge, so that both edges will be of the same configuration as the hinge side edge of door 10, wherein a substantial portion of the stile 26 extends between but does not project beyond the opposed flanges 33.

While the articles herein described constitute preferred embodiments of the invention, it is to be understood that the invention is not limited to these precise articles and that changes may be made therein without departing from the scope of the invention which is defined in the appended claims.

What is claimed is:

1. A fire resistant door for hinges mounting in a door frame having a hinge jamb and a lock jamb, comprising:

(a) means including wood hinge side and lock side stiles and wood top and bottom rails forming a rectangular door skeleton, (b) a pair of rectangular metal skins each covering one side of said door skeleton and having an integral inturned flange along each edge thereof interfitting with the adjacent said stile or rail, (c) each of said flanges being substantially less in width than one-half the thickness of said stiles whereby a substantial portion of the outer edge of each of said stiles extends between opposed said flanges, (d) a plurality of leaf hinges mounted in spaced relation on said hinge side stile, (e) means securing one leaf of each said hinge directly to one of said flanges interfitting with said hinge side stile, and (f) mechanical means substantially more combustion-resistant than wood forming a direct connection between said skins at a position adjacent said lock side stile, (g) whereby upon combustion of said stiles and rails while said door is mounted in a door frame, said skin secured to said hinges will remain attached to said hinge side of said frame through said hinges, and said skins will remain directly connected to each other adjacent said lock jamb of said frame.

2. A door as defined in claim 1 wherein said means securing said hinges to said door include self-tapping screws threaded through said one skin flange along said outer edge of said hinge side stile.

3. A door as defined in claim 2 wherein said mechanical means comprises a metal strap extending across the top of said door adjacent said lock side stile, and means directly connecting said strap with opposed said flanges overlapping said top rail.

4. A door as defined in claim 3 wherein said connecting means comprises self-tapping screws threaded through said flanges and said strap.

5. A door as defined in claim 4 wherein said stiles have rabbets extending along the outer corners thereof, and said flanges on the sides of said skins are received in said rabbets.

6. A door as defined in claim 3 wherein said rabbets along said lock side stile are wider as measured laterally of said door than the thickness of said flanges therein to provide a portion of said stile projecting between and beyond said flanges.

7. A door as defined in claim 1 wherein said mechanical means comprises a metal strap extending across the top of said door adjacent said lock side stile, and means directly connecting said strap with opposed said flanges overlapping said top rail.

8. A door as defined in claim 7 wherein said connecting means comprises self-tapping screws threaded through said flanges and said strap.

9. A door as defined in claim 1 wherein said stiles have rabbets extending along the outer corners thereof, and said flanges on the sides of said skins are received in said rabbets.

10. A door as defined in claim 9 wherein said rabbets along said lock side stile are wider as measured laterally of said door than the thickness of said flanges therein to provide a portion of said stile projecting between and beyond said flanges.

* * * * *